United States Patent [19]

Braxmeier

[11] Patent Number: 4,807,431

[45] Date of Patent: Feb. 28, 1989

[54] AIR NOZZLE FOR PNEUMATIC FALSE-TWIST SPINNING HAVING A YARN CHANNEL THAT IS FORMED OF AT LEAST TWO SEGMENTS

[75] Inventor: Hans Braxmeier, Süssen, Fed. Rep. of Germany

[73] Assignees: Fritz Stahlecker; Hans Stahlecker, both of Fed. Rep. of Germany

[21] Appl. No.: 140,635

[22] Filed: Jan. 4, 1988

[30] Foreign Application Priority Data

Jan. 15, 1987 [DE] Fed. Rep. of Germany ..... 3700926
Sep. 29, 1987 [DE] Fed. Rep. of Germany ..... 3732708

[51] Int. Cl.[4] ..... D02G 1/04; D02G 1/16; D01H 5/28; D01H 7/92

[52] U.S. Cl. ..... 57/333; 28/271; 28/273; 57/328; 57/350

[58] Field of Search ..... 28/271–276; 57/333, 350, 6, 328

[56] References Cited

U.S. PATENT DOCUMENTS

| | | | |
|---|---|---|---|
| 2,994,938 | 8/1961 | Loveland et al. | 28/273 |
| 3,188,713 | 6/1965 | Dyer et al. | 28/273 |
| 3,204,396 | 9/1965 | Foster et al. | 57/333 X |
| 3,340,684 | 9/1967 | Shichman | 57/333 X |
| 3,380,242 | 4/1968 | Richmond et al. | 28/273 X |
| 3,407,584 | 10/1968 | Radecki et al. | 57/333 X |
| 3,916,493 | 11/1975 | Ethridge | 28/273 |
| 4,480,435 | 11/1984 | Anahara et al. | 57/333 |
| 4,547,938 | 10/1985 | Cullen et al. | 28/272 X |
| 4,581,886 | 4/1986 | Coll-Tortosa | 57/333 |

*Primary Examiner*—John Petrakes
*Attorney, Agent, or Firm*—Barnes & Thornbrug

[57] ABSTRACT

In the case of an air nozzle for pneumatic false-twist spinning having a yarn channel formed of at least two segments and having at least one compressed-air duct leading into the yarn channel, it is provided that for the formation of each compressed-air duct, a groove is worked into one of the segments that is open in the direction of the contact of the other segment and that is covered by the segment that follows. To accommodate selective changes in the compressed air duct configuration the segments are replaceable parts that are clamped by screw threaded nozzle housing parts.

14 Claims, 2 Drawing Sheets

AIR NOZZLE FOR PNEUMATIC FALSE-TWIST SPINNING HAVING A YARN CHANNEL THAT IS FORMED OF AT LEAST TWO SEGMENTS

BACKGROUND AND SUMMARY OF THE INVENTION

The invention relates to an air nozzle for pneumatic false-twist spinning having a yarn channel that is formed of at least two segments that are arranged behind one another in moving direction of the yarn and connect to one another with contact surfaces, and having at least one compressed-air duct leading into the yarn channel.

In the case of air nozzles of this type, it is of considerable importance that the direction and the position of the mouth of the compressed-air duct into the yarn channel is positioned precisely. Even small deviations may result in considerable differences in the false-twisting effect. In the case of a known construction (U.S. Pat. No. 4,480,435), it is therefore provided that the yarn channel consists of two segments that are arranged behind one another. One segment forms a housing into which the smaller segment is inserted that also forms a section of the yarn channel with a smaller diameter. The inserted segment contains several compressed-air ducts that are developed as bores and whereby bores with particularly small diameters are to be made possible. The making of these bores requires considerable expenditures if the required precisions are to be maintained.

An objective of the invention is to provide an air nozzle of the initially mentioned type into which compressed-air ducts can be worked in a simple way with a high precision concerning their direction and the position of their mouth.

This objective is achieved by working a groove into one of the segments for the forming of each compressed-air duct. This groove is open in the direction of the contact surface and is covered by the connecting segment.

In the case of this development, the compressed-air ducts are produced in the form of grooves that can be created in a simple way with high precision, for example, by means of milling. The compressed-air channels will then be completed into a closed duct by means of the other segment only when the air nozzle is assembled. Since before the assembly, these compressed air channels are exposed, they can be examined easily with respect to their precision, and if necessary, can be reworked. During this examination, defective segments can also be sorted out.

In a further development of the invention, it is provided that the contact surfaces, between two segments between which the at least one compressed air duct is formed, are developed as conical surfaces. As a result, in an also uncomplicated way, compressed-air ducts can be produced that have a Predetermined slope with respect to the moving direction of the yarn.

In the case of another development of the invention, it is provided that the contact surfaces between two segments, between which the at least one compressed-air duct is formed, are aligned radially with respect to the moving direction of the yarn.

In a further development of the invention, it is provided that the two segments, between which the at least one compressed-air duct is formed, form sections with different diameters for the yarn channel, in which case, the section that follows in yarn moving direction has a larger diameter. By means of this sudden or step-by-step enlargement of the diameter, despite the arrangement of the compressed-air ducts in a radial plane, a clear flow-off direction for the blown-in compressed air is obtained, because it flows off in the direction of the larger diameter of the yarn channel.

In a further development of the invention, it is provided that the segments in moving direction of the yarn, while supporting one another, are clamped into a housing. As a result, it is possible to exchange the segments in order to create air nozzles with a different effect. The segments must then only have outer contours that match the housing, while their interior development that is decisive for their functioning as an air nozzle, can be adapted to the respective conditions. In this case, it is possible, by means of the selection of corresponding segments, to create so-called intake nozzles that, without generating a twist or at least without generating any significant twist, produce an air flow in the moving direction of the yarn, or air nozzles that cause a very strong false twist.

In the case of an advantageous embodiment of the invention, it is provided that the housing—seen in moving direction of the yarn—in the area of one of its ends, is provided with a support surface for a clamping surface of the first one of the segments, and in the area of the other end, is provided with a receiving device for a clamping insert that, in the direction to the support surface, is connected with the last one of the segments in a form-locking way. Into this housing, segments may be clamped that all have the same outer contour, but that may have very different developments in their interiors.

In a further development of the invention, it is provided that the housing, between the support surface and the receiving device of the clamping insert, forms a toroidal chamber that surrounds the segments at a distance, this toroidal chamber being provided with a connection for a compressed-air supply line. As a result, it is possible to arrange segments within the housing, the compressed-air ducts of which may be located at different points.

Other objects, advantages and novel features of the present invention will become apparent from the following detailed description of the invention when considered in conjunction with the accompanying drawings.

DETAILED DESCRIPTION OF THE DRAWINGS

Figure 1:
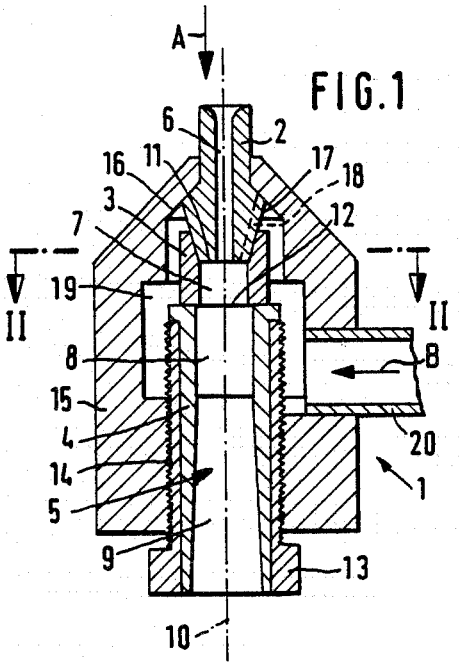
FIG. 1 is a sectional schematic view of an air nozzle constructed according to a preferred embodiment of the invention, as viewed in the longitudinal direction corresponding to the yarn moving direction.
Figure 2:
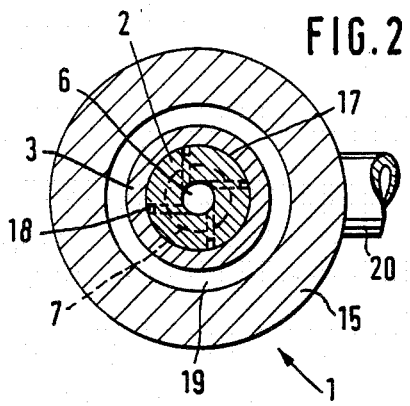
FIG. 2 is a sectional view taken along line II—II of FIG. 1.

The air nozzle 1 that is shown in FIGS. 1 and 2 has three segments 2, 3, 4 that are arranged behind one another in moving direction (A) of the yarn and form a yarn channel 5. The first segment 2 forms a cylindrical first section 6, provided with a funnel shaped inlet, for the yarn channel 5. Connected to this first section 6, is a cylindrical section 7 that is significantly expanded in its diameter and is formed by the second segment 3. This cylindrical section 7, in turn, is followed by a cylindrical section 8 that is also expanded in its diameter and that is followed by a slightly conically expanding section 9. Sections 8 and 9 of the yarn channel 5 are formed by segment 4.

Several compressed-air ducts 18 lead into the yarn channel 5, the mouths of these compressed-air ducts being located in the front face 11 of segment 2 and thus leading indirectly into section 7 of the yarn channel 5 that with respect to the first section 6, is significantly enlarged in its diameter. The compressed-air ducts 18 consist of straight grooves that are worked into the contact surface 17 of segment 2 and that may be produced, for example, by being milled in. These grooves will be closed to form the compressed-air ducts 18 only by the contact surface of the following segment 3 by means of which it rests against contact surface 17.

As shown in FIG. 1, the contact surface 17 of segment 2 and the pertaining contact surface of the following segment 3 are developed as conical surfaces that taper in the moving direction (A) of the yarn. Thus, the compressed-air ducts 18 that are formed from straight grooves with a constant depth obtain a corresponding slope in moving direction (A) of the yarn so that they act as injector nozzles.

As shown in FIG. 2, the compressed-air ducts 18, with respect to the center of the Yarn channel 5, are slightly offset in the same direction so that they also produce an air whirl that exercises a false twist on a yarn 10 that is guided through the yarn channel 5. When this false-twisting effect is to be increased, the compressed air ducts 18 may be offset correspondingly farther to the outside until they extend approximately tangentially with respect to section 7 of segment 3. When no false twist is to be produced, the compressed-air ducts 18 are mounted in such a way that they are aligned radially with respect to the center of the yarn channel 5.

The three segments 2, 3, 4 are exchangeably clamped into a housing 15. The approximately cup-shaped housing 15, at one of its ends, has a support surface 16 for a clamping surface of segment 2 that is first in moving direction (A) of the yarn. As shown in FIG. 1, the support surface 16 and the clamping surface that is provided at the outside of segment 2 are developed as conical surfaces that taper against the moving direction (A) of the yarn. The other end of the housing 15 is provided with a threaded bore 14 that is used as a receiving device for a clamping insert 13 and into which the clamping insert 13 is screwed that is developed as a threaded sleeve. In the direction of the support surface 16, the clamping insert 13 supports itself against a collar of segment 4 that is inserted into the clamping insert 13. Segment 4, with its front face 12, presses segment 3 toward segment 2 that is braced against the support surface 16 by the screwing-in of the clamping insert 13. By means of the release of the clamping insert 13, the segments 2, 3, 4 can be dismounted and exchanged in a simple way. In this case also, as explained later by means of FIGS. 3 and 4, an exchange for segments 2, 3, 4 is possible that have a corresponding outer contour but that, with respect to their inner development producing the false twist, are developed differently.

As also shown in FIGS. 1 and 2, the housing 15 is widened between the support surface 16 and the receiving device 14 that is developed as a thread, so that it forms a toroidal chamber 19 that surrounds the segments 2, 3, 4. This toroidal chamber 19 is provided with a connection for a compressed-air supply line 20 by means of which compressed air is supplied in the direction of the Arrow (B). This compressed air, via the toroidal chamber 19, reaches the inlet openings of the compressed-air ducts 18. The toroidal chamber 19 is developed in such a way that the compressed-air ducts 18, without a change of the housing 15, may be located at very different points.

Figure 3:
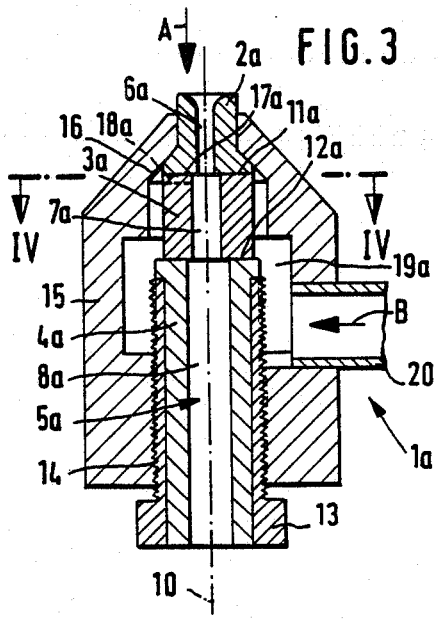
FIG. 3 is a longitudinal sectional view through another embodiment of an air nozzle that is formed by using the same housing on the FIG. 1 arrangement.
Figure 4:
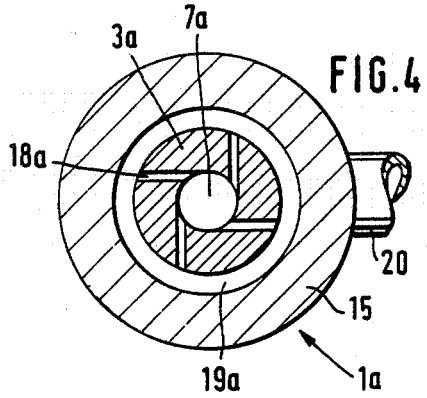
FIG. 4 is a sectional view taken along Line IV—IV of the air nozzle according to FIG. 3.

As shown in FIGS. 3 and 4, while maintaining the basic structure and using the same housing 15 and the same clamping insert 13, an air nozzle **1*a* can be obtained that is completely different in its operation and that, in the case of this embodiment, is developed as a pure false-twisting nozzle. This air nozzle la also contains three segments 2*a*, 3*a*, 4*a* that, behind one another in moving direction (A) of the yarn, are clamped into the housing 15 and that form a yarn channel 5*a* for a yarn 10. The first segment 2*a* has a cylindrical section 6*a* of the yarn channel 5*a* that is equipped with an inlet funnel. Connected to it, is a section 7*a* of the yarn channel 5*a* that is wider in its diameter and that is formed by segment 3*a*. Via an also sudden widening of the diameter, section 7*a* of the yarn channel 5*a* is followed by a cylindrical section 8*a* that is provided in segment 4*a*. Also in the case of this embodiment, compressed-air ducts 18*a* are provided between segments 2*a* and 3*a*. These compressed-air ducts 18*a*, in the case of this embodiment, are formed by the fact that grooves are worked into the contact surface of segment 3*a* that is opposite the front face 17*a* of segment 2*a* aimed radially with respect to the moving direction (A) of the yarn, these grooves being located in a plane that is radial with respect to the moving direction (A) of the yarn. The grooves that all have a uniform depth and extend in a straight line are made into complete compressed-air ducts 18*a* by the front face 11*a* of segment 2*a***.

As shown in FIG. 4, the grooves and thus the ducts **18*a* are directed in such a way that they extend in the same direction approximately tangentially with respect to section 7*a* of the yarn channel 5*a***.

Also in the case of the embodiment according to FIGS. 3 and 4, the segments **2*a*, 3*a* and 4*a* are clamped into the housing 15 in a corresponding way. Segment 2*a* has a conical clamping surface that supports and centers itself at the support surface 16 of the housing 15 that is developed as a conical surface. Segment 4*a* is inserted into the clamping insert 13 that is applied at a collar of segment 4*a* and presses it, with its front face 12*a*, against the opposite contact surface of segment 3*a* that, in turn, is braced with respect to segment 2*a*. In order to obtain, in the case of this embodiment, a correct position of segment 3*a* with respect to segments 2*a* and 4*a*, during the assembly, a mandrel is used, onto which segments 2*a*, 3*a* and 4*a* are fitted. After the clamping insert 13 was screwed in, segment 3*a*** is braced in such a way that the mandrel can be removed.

Figure 5:
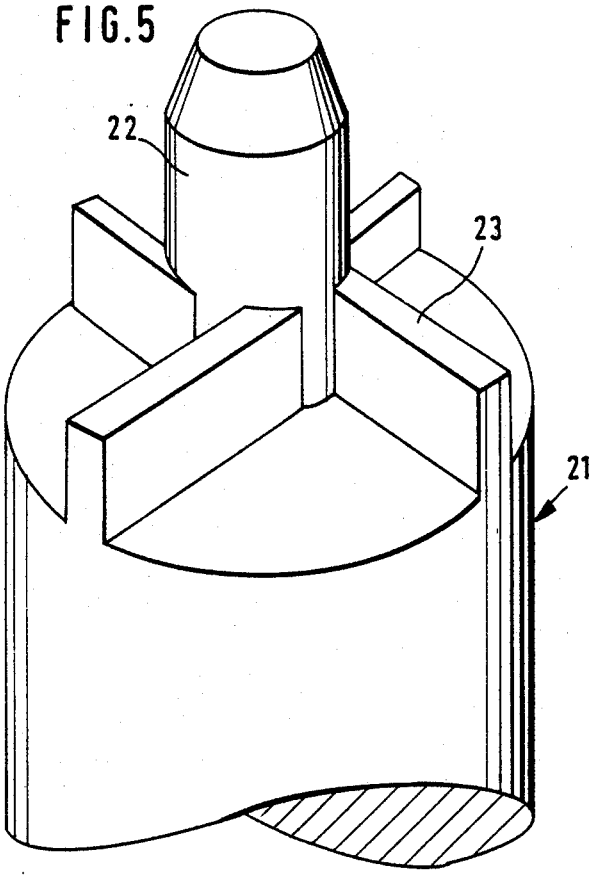

In the case of the embodiments shown in FIGS. 1 to 4, straight grooves are provided in segments 2, 3*a* that, together with segments 3, 2*a*, form the compressed-air ducts 18, 18*a*. Grooves of this type may be produced, for example, by milling. When other shapes are to be provided for the grooves, namely profiled shapes, such as, for example, rounded inlets and outlets, a rounded cross-section and, if necessary, a narrowing in the manner of a Laval nozzle, other manufacturing processes are more suitable for the grooves. Since the grooves have heights and widths of only less than 1 mm, for example, in the magnitude of 0.5 mm, it is provided in a development of the invention that the grooves are stamped in by means of stamping dies 21, as shown in a very enlarged scale in FIGS. 5 to 7. The shown stamping dies 21 are used, for example, for producing the grooves in segment 3*a*. Stamping die 21 has a pin stop 22 by means of which it enters into section 7*a* of the yarn channel 5*a*, so that section 3*a* is centered. The stamping die 21 is in that case provided with ribs 23 that are arranged corresponding to the number of grooves and that represent the negative mold for the grooves. These ribs 23 are pressed into segment 3*a* that consists of a correspondingly deformable material, for example, of aluminum. The stamping takes place in that no elevations remain in the area of the front face of segment 3*a* that face segment 2*a*. This means that the surfaces between the stamping ribs 23 must flatten this front face. Material can therefore be pressed only to the outside in the circumferential area, from where it is removed by means of metal cutting processes.

Figure 6:
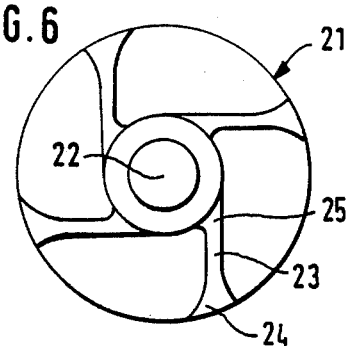
FIGS. 5 to 7 are views of stamping tools for making profiled grooves in the segments forming the nozzles of FIGS. 1 through 4.
Figure 7:
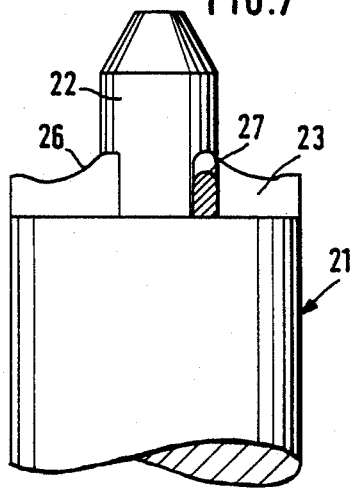

As shown in FIGS. 6 and 7, it is possible, by means of stamping dies 21 of this type, to provide the grooves with a shape that deviates from the straight shape. It is possible, for example, to widen the end areas 24, 25 so that rounded inlets and outlets are obtained. It is also possible to raise the stamping ribs 23 in the area of the ends so that a widening is obtained for the grooves in the manner of a Laval nozzle.

Correspondingly profiled shapes of the grooves are naturally also possible when segments 2 and 3*a* that are provided with these grooves, are manufactured as cast parts and particularly as diecast parts. In this case, it is also possible to manufacture segments 2, 3; 2*a*, 3*a* as plastic molded parts because these parts are not subjected to any wear. To the extent that they are used for guiding the fiber material, like, for example, segment 2, 2*a*, it is possible to insert ceramic inserts into these plastic parts.

Although the present invention has been described and illustrated in detail, it is to be clearly understood that the same is by way of illustration and example only, and is not to be taken by way of limitation. The spirit and scope of the present invention are to be limited only by the terms of the appended claims.

I claim:

1. Pneumatic false-twist spinning nozzle apparatus comprising:

nozzle housing means, and a plurality of yarn channel segments disposed adjacent one another to form a yarn channel through the housing means, said yarn channel segments being clampingly exchangeably held in position in the housing means with said segments in end to end abutting relationship, wherein a compressed air supply chamber is formed in the housing means which extends over a portion of the axial length of the yarn channel segments and which has a connection opening for a compressed air supply, wherein at least one compressed air duct extends from the compressed air supply chamber and opens into the yarn channel to supply compressed air in a direction tangentially to the yarn travel path to thereby apply false twist to yarn travelling through the yarn channel, and wherein said at least one compressed air duct is formed by axially open groove means at an axial end face of one of said yarn channel segments and an adjacent end face of an abutting axially adjacent one of the yarn channel segments which serves to close the groove means and form a respective closed compressed air duct.

2. Apparatus according to claim 1, wherein the abutting axial end faces between which there is at least one compressed air duct is formed are formed as respective conical surfaces.

3. Apparatus according to claim 2, wherein the two segments between which the at least one compressed-air duct is formed, form sections with different diameters for the yarn channel, the section that follows in traveling direction of the yarn having a larger diameter that the preceeding section.

4. Apparatus according to claim 2, wherein the groove means of the segments are profiled.

5. An air nozzle according to claim 1, wherein the abutting axial ends between which the at least one compressed-air duct is formed are aligned radially with respect to the travel path of the yarn through the yarn channel.

6. Apparatus according to claim 5, wherein the two segments between which the at least one compressed-air duct is formed, form sections with different diameters for the yarn channel, the section that follows in traveling direction of the yarn having a larger diameter.

7. Apparatus according to claim 5, wherein the groove means of the segments are profiled.

8. An air nozzle according to claim 1, wherein the two segments between which the at least one compressed-air duct is formed form sections with different diameters for the yarn channel, the section that follows in the travel direction of the yarn through the yarn channel having a larger diameter than the preceeding section.

9. Apparatus according to claim 1, wherein said housing means exhibits an internal clamping surface at one end which clampingly engages a clamping surface of one of said segments, and wherein a receiving device is disposed at the opposite end of the housing means, said receiving device including a clamping insert which is connectible in a form locking way to axially clamp another of said segments in said housing means.

10. Apparatus according to claim 9, wherein one of the internal clamping surfaces at one end of the housing means and the clamping surface of the pertaining segment has a conical shape.

11. Apparatus according to claim 10, wherein the housing means forms a toroidal chamber that surrounds the segments at a distance between the clamping surface and the receiving device for the clamping insert, said toroidal chamber being equipped with a connection for a compressed-air supply line.

12. Apparatus according to claim 1, wherein the groove means of the segments are profiled.

13. Apparatus according to claim 1, wherein said segments are separate parts which can be exchangeably replaced to selectively form different compressed air duct configurations.

14. Apparatus according to claim 13, wherein said segments are clampingly held by threadedly connected nozzle housing means parts.

* * * * *